United States Patent [19]

Abildgaard et al.

[11] 3,964,770

[45] June 22, 1976

[54] CASE FOR BOOK WITH PRESSURE SENSITIVE RESILIENT SPINE PAD

[75] Inventors: William H. Abildgaard, Los Altos Hill; Charles T. Groswith, III, Los Altos, both of Calif.

[73] Assignee: Velo-Bind, Inc., Sunnyvale, Calif.

[22] Filed: Feb. 3, 1975

[21] Appl. No.: 546,606

Related U.S. Application Data

[63] Continuation of Ser. No. 206,001, Dec. 8, 1971, abandoned, which is a continuation-in-part of Ser. Nos. 79,086, Oct. 8, 1970, Pat. No. 3,730,560, and Ser. No. 146,648, May 25, 1971, Pat. No. 3,749,423.

[52] U.S. Cl. ..... 281/29

[51] Int. Cl.[2] ..... B42D 3/00

[58] Field of Search ..... 281/21 R, 29, 36, 37; 428/40; 24/67 A

[56] References Cited

UNITED STATES PATENTS

| | | | |
|---|---|---|---|
| 1,495,467 | 5/1924 | White | 281/37 |
| 1,602,816 | 10/1926 | Fellows | 281/29 X |
| 1,991,608 | 2/1935 | Frazier | 281/29 |
| 3,059,946 | 10/1962 | Paddack | 281/29 |
| 3,188,114 | 6/1965 | O'Brien et al. | 281/21 R |
| 3,210,093 | 10/1965 | Steidinger | 281/21 R |
| 3,306,631 | 2/1967 | Bernson | 281/29 |

FOREIGN PATENTS OR APPLICATIONS

| | | | |
|---|---|---|---|
| 202,859 | 12/1955 | Australia | 428/40 |

*Primary Examiner*—Jerome Schnall
*Attorney, Agent, or Firm*—Julian Caplan

[57] ABSTRACT

By means of only slightly modified case making equipment, a hard case for a book is provided with a pad which is attached to the spine edge of an uncased book by pressure-sensitive adhesive. This pad comprises a strip of foam of a material such as polyurethane of a length substantially the same as that of the cover boards for the case and a width slightly less than the gap between adjacent boards which is fastened to the cover material by the same adhesive which causes the cover material to adhere to the boards. In order to provide a non-porous surface for the foam, the latter may be covered by a layer of vinyl, the latter being of the same length and width as the pad and stuck thereto by a suitable adhesive. A layer of pressure-sensitive adhesive material is applied to the vinyl and a protective release paper covers the pressure-sensitive adhesive. The adhesive and release paper are spaced inward at top and bottom from the top and bottom edges of the boards. In production of the case the top and bottom of the cover material are turned in to cover the edges of the boards and such turn-ins also cover the ends of the pad but not the release paper. In use, the release paper is stripped off exposing the pressure-sensitive material. The spine edge of the uncased book is forced against the pressure-sensitive material. End leaves of the book are caused to adhere to the boards.

1 Claim, 6 Drawing Figures

CASE FOR BOOK WITH PRESSURE SENSITIVE RESILIENT SPINE PAD

This application is a continuation of application Ser. No. 206,001, filed Dec. 8, 1971, (now abandoned) which was a continuation-in-part of applications Ser. No. 79,086, filed Oct. 8, 1970, now U.S. Pat. No. 3,730,560 which issued May 1, 1973; and Ser. No. 146,648 filed May 25, 1971, now U.S. Pat. No. 3,749,423 issued July 31, 1973.

This invention relates to a new and improved case for books with a pressure-sensitive coated resilient spine pad initially protected by release paper applied to the spine area of the case.

A principal object and advantage of the present invention is the reduction in the number of operations required to bind a book and more particularly to attach the uncased book to the case. The labor required is materially reduced, the use of much bindery equipment is eliminated, and the amount of additional equipment required is minimal and inexpensive.

A further feature of the invention is the reduction in the amount of skilled labor required to case a book.

A present invention is compatible with standard book manufacture and with standard book case manufacture, but a stronger and more durable book construction results.

A particular feature of the invention is the provision of a case having installed therein a pad of resilient material coated with pressure-sensitive adhesive and initially protected with release paper. This pad is applied to the case as it is being manufactured and is preferably held in place by the same adhesive which secures the boards of the cover in position on the cover of material. The pad preferably has a backing of resilient material such as polyurethane foam which may optionally be surfaced with a layer of vinyl material. Pressure-sensitive adhesive is applied to the vinyl or the foam for a substantial portion of the length of the pad and said adhesive is initially covered with release paper. To assemble the case to an uncased book, the release paper is first stripped off exposing the pressure-sensitive adhesive. The spine of the uncased book is then pressed against the pressure-sensitive adhesive causing adherence and the edges of the pad are curved around the outside of the spine marginal areas of the uncased book. By means forming no part of the present invention, the end leaves of the uncased book are caused to adhere to the inside of the case.

Still another feature of the invention is the fact that the pressure sensitive adhesive of the pad is initially protected by release paper which is longer than the patch of adhesive. Thus, at one or both ends of the pad is a tab of release paper which is not in contact with adhesive. Stripping the release paper is facilitated by gripping the tab.

Other objects of the present invention will become apparent upon reading the following specification and referring to the accompanying drawings in which similar characters of reference represent corresponding parts in each of the several views.

The present invention is adapted to use in fabrication of hard cases for books which are closely similar to standard cases and are fabricated on standard case forming machines with slight modification.

Figure 2:
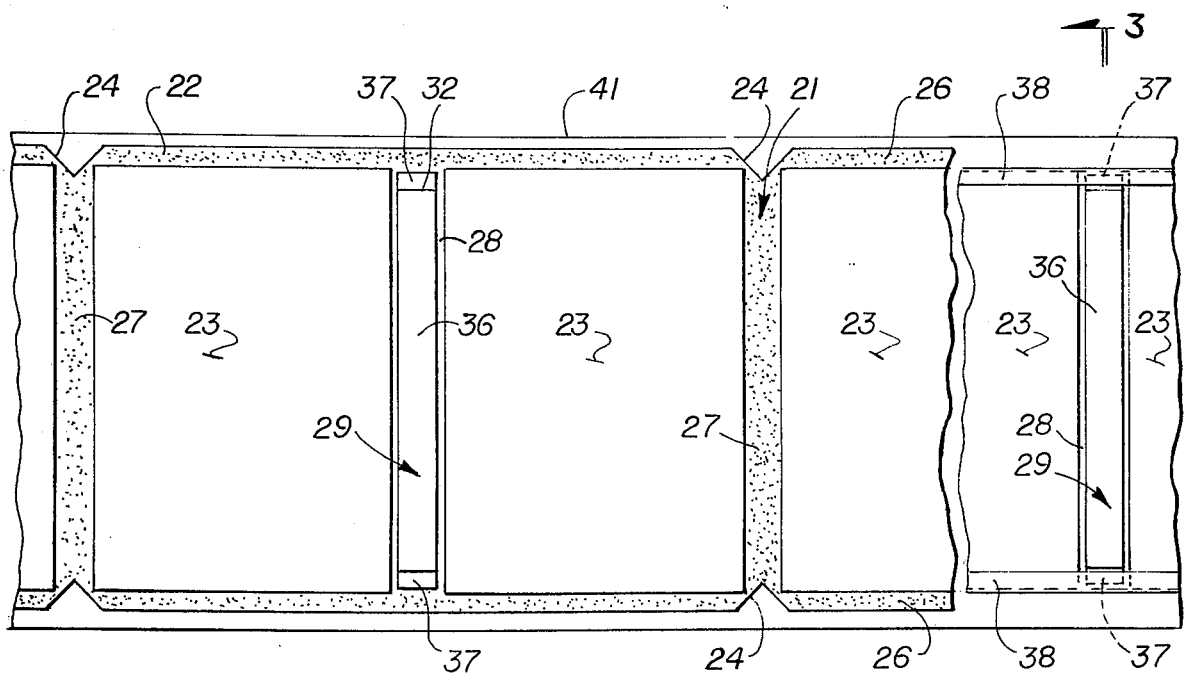
FIG. 2 is a fragmentary top plan of a web of cover material showing the pad applied.

The case making machine advances from station to station a web 21 of cover material which has a width slightly greater than the ultimate height of the case to be formed. The top surface of web 21 is coated with an adhesive 22. At intervals, cover boards 23 are applied and are caused to adhere to the web 21 because of the presence of the adhesive 22. Between every two covers notches 24 are formed in the top and bottom edges of the web 21 to form the corners of the eventual case. As is best shown in FIG. 2, top and bottom margins 26 are located between the top and bottom edges of the boards 23 and the edges of the web 21. These margins are later folded over in turnins 38 to finish off the top and bottom edges of the case. Gaps 27 are located between notches 24 and between the adjacent edges of the boards 23 of adjacent cases. Eventually each gap 27 is cut in half and the material is folded over the adjacent boards 23 in turnins 39 to finish off the end edges of the cases. There is also a gap 28 between the adjacent edges of the board 23 equal to the width of pad 29 plus an additional width to accommodate turning the pad 29 over the edges of the uncased book and also to provide a thin area for the formation of a bead in the finished book. The pad 29 of the present invention is applied extending in the gap 28.

Figure 3:
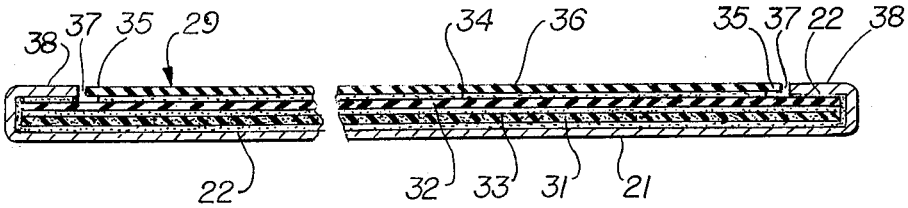
FIG. 3 is an enlarged sectional view taken substantially along the line 3—3 of FIG. 2.

Pad 29 consists of a bottom layer 31 of a resilient material such as polyurethane, vinyl or latex foam. As is best shown in FIG. 3, when the pad 29 is applied to the top surface of the web 21, the bottom of the foam 31 sticks to the adhesive 22 which has been applied to the top surface of the web. Because foam is generally porous, in the form of the invention shown in FIG. 3 a cover of vinyl 32 is applied by means of adhesive 33, the dimensions of the vinyl 32 being identical with that of the foam 31 when viewed in plan. A layer of pressure-sensitive adhesive 34 is applied on top of the vinyl 32 in the form of the invention shown in FIG. 3, the length of the adhesive layer 34 being less than that of the foam 31 by a distance at each end 37 which is slightly greater than the marginal turnin 38. The adhesive 33 is initially protected by release paper 36 which may be a layer of polyethelene coated with silicone to facilitate stripping. The ends of the release paper 36 are disposed inward from the edges of the pad 31 leaving exposed ends 37 which are not coated with adhesive and which are not covered by release paper. The length of end 37 is slightly greater than the length of turnin 38. Further, the length of release paper 36 at least at one end is greater than the length of adhesive 34, thus providing tab 35 which may be gripped to facilitate stripping off the release paper 36.

After the pad has been applied by means hereinafter described or other means, the margins 26 are turned in to overlie the edges of the boards 23 to form top and bottom edge turn-ins 38 which conceal the edges of the boards 23. In accordance with the present invention, the turn-ins 38 also cover most but not all of the ends 37 and assist in securing the pad 29 to the web 21. At a subsequent station of the machine, the gap 27 is split transversely and side edge turn-ins 39 are formed overlying the end edges of the boards 33. By reason of the notches 24, mitered corners 40 are formed at the intersections of turn-ins 38 and 39.

Figure 1:
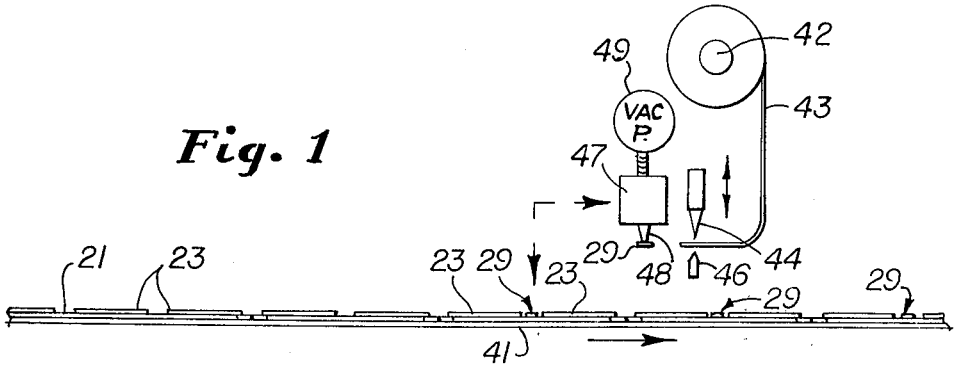
FIG. 1 is a schematic side elevational view of a portion of a case making machine wherein the pad of the present invention is applied.

The case of the present invention may be made on a standard case making machine, portions of which are illustrated schematically in FIG. 1. A table 41 is provided along which the web 21 advances intermittently. As the web 21 approaches the station shown in the middle of FIG. 1, adhesive 22 has been applied to the web 21 and boards 23 placed on the web and caused to adhere thereto. In a super-structure above table 41 a roll 42 of pad forming material is mounted, the width of the roll being equal to the width of the pad 29 and the vinyl 32 (where used) and release paper 36 applied thereto. It will be understood that in normal manufacturing operation, the adhesive 34 is first applied to the release paper 36, and the release paper is then brought in contact with the vinyl 32 under pressure. Thereafter when the release paper 36 is stripped off, the adhesive 34 remains with the vinyl 32. A length of the web 43 from which the pad 29 is to be cut is fed from the roll 42 to a cutting station consisting of a reciprocating cut-off knife 44 and a stationary shear blade 46. The knife 44 cuts off a portion of the web 43 equal to the width of pad 29. The vacuum head 47 is mounted for movement near the knife 44. Said head 47 has a plurality of vacuum nozzles 48 on its lower surface through which a vacuum is drawn by means of pump 49. The head 47 is caused to move from an initial position where the nozzles 48 contact the pad 29 as it is being cut off by the blade 46 and then move to the left as viewed in FIG. 1 and then downwardly, depositing the pad 29 on the web 21 between adjacent boards 23. The vacuum is then released and the pad sticks to the adhesive 22 on the web 21 while the head 47 returns for delivery of the next pad 29.

By means forming no part of the present invention and well understood in the art, the margins 26 are folded over to form the turn-ins 38 and the side edge turn-ins 39 are also formed.

Figure 4:
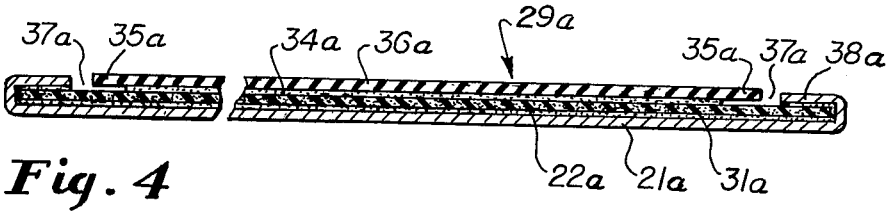
FIG. 4 is a view similar to FIG. 3 of a modification.

Directing attention to FIG. 4, it will be seen that the layer of vinyl 32 and its adhesive 33 have been eliminated and the pressure-sensitive adhesive 34*a* is attached directly to the foam pad 31*a*. In other respects, the structure of FIG. 4 resembles that of FIG. 3 and the same reference numerals followed by subscript *a* are used to designate corresponding parts.

Figure 5:
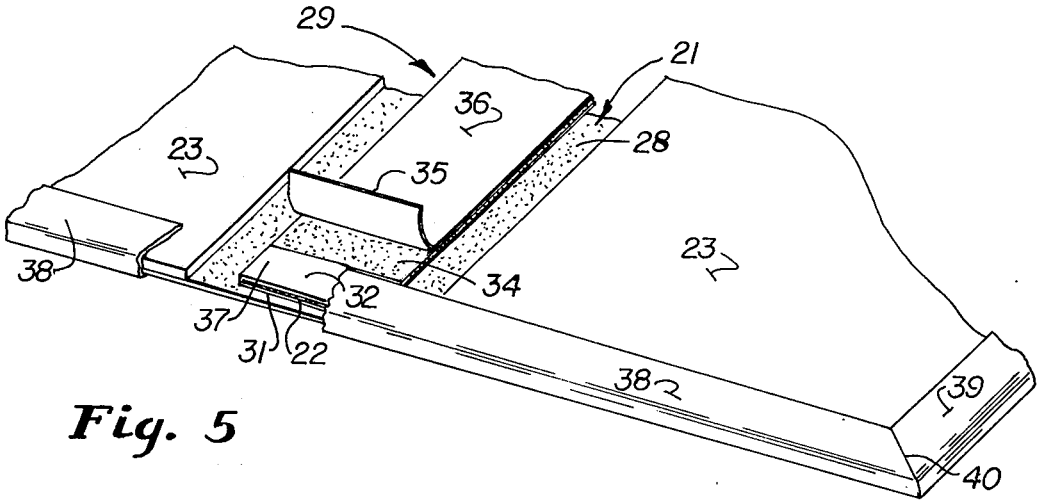
FIG. 5 is a fragmentary perspective view of a case formed in accordance with the present invention partially broken away in section to reveal internal construction.

Directing attention to FIG. 5, the completed case is shown somewhat schematically and fragmentarily. The first step in assembly of the book is to strip off the release paper 36, exposing the pressure-sensitive adhesive 34. The length of release paper 36 is short enough so that the turn-ins 38 have not covered the ends of the release paper. Further as is best shown in FIGs. 3 and 4, the length of pressure-sensitive 34 is less than that of the release paper 36 enabling the fingernail of the user (or some mechanical instrumentality where automatic machinery is employed) to enter under the tab 35 of the release paper 36 to facilitate stripping. The beginning of this operation is shown in FIG. 5.

An uncased book 56 is then applied to the pad 29 by forcing its spine edge 61 against the pressure-sensitive adhesive 34, causing adherence. The construction of uncased book 56 is subject to considerable variation. However, in a preferred embodiment a plurality of sheets 57 is bound together adjacent the spine edges by means of plastic strips 58 having integral studs (not shown) which extend through holes in the sheets 57 adjacent the spine margins thereof and also extend through matching holes in a companion strip 59. Heads 62 are formed on the ends of the studs. The structure of the uncased book 56 is shown in U.S. Pat. No. 3,596,929 issued Aug. 3, 1971. It will be appreciated that other uncased book structures may be employed.

Figure 6:
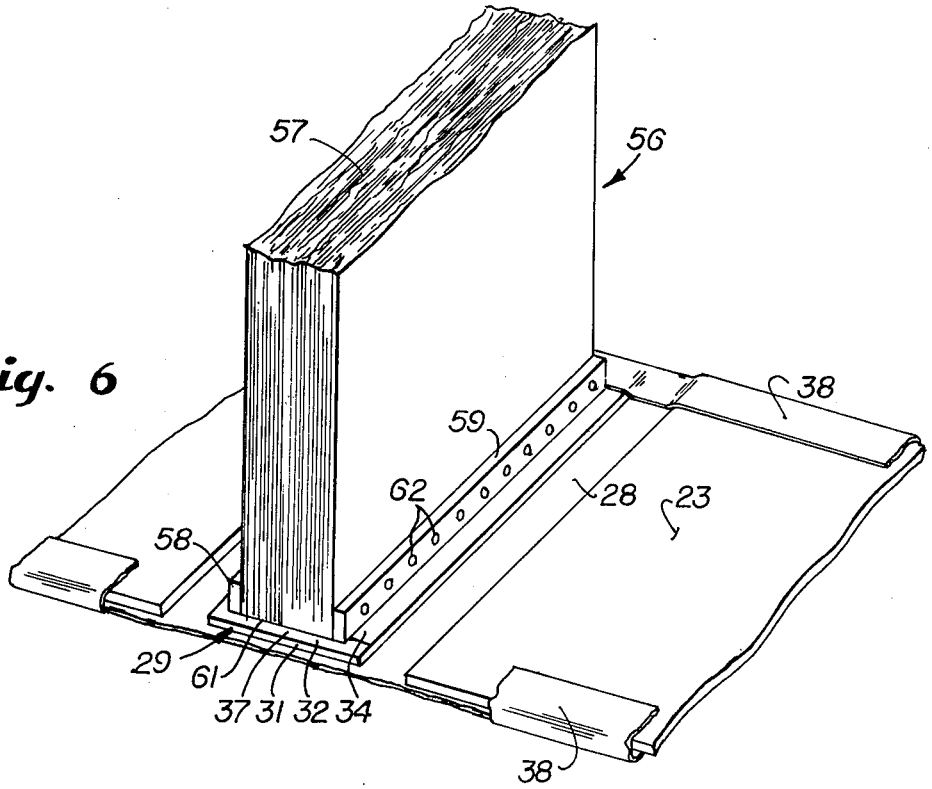
FIG. 6 is a fragmentary sectional view showing a step in the assembly of the uncased book to the case.

The conclusion of the attachment of the spine edge 61 of uncased book 56 to the pad 29 is shown in FIG. 6. The portions of the pad 31 which extend to either side of the spine of the book may be brought around to cover at least portions of the plastic strips 58 and 59 or the side edges of the strip. The end sheets 57 may be caused to adhere to the insides of the boards 23 by various means such as adhesives.

The term "foam" is used to include a resilient material such as polyurethane, vinyl or latex foam.

What is claimed is:

1. A case for a book for adherence to an uncased book, said case comprising a flexible outer cover, a board on each side of said case, said boards adhering to said cover and being spaced apart to provide a longitudinal central spine area between said boards and a pad attached centrally of said spine area extending longitudinally of said spine area with hinge forming areas on either side between said pad and said boards, said hinge forming areas comprising said flexible outer cover, each said hinge forming area being of substantially equal width, said pad comprising a layer of foam plastic backing material and being resiliently deformable to accommodate unevenness in the spine of the uncased book to which said pad is to be adhered said pad being attached to said spine area by a layer of adhesive on one side of said backing material, a layer of vinyl material of a length equal to that of said backing material, means securing said vinyl material to said backing material on the side of said backing material opposite the side attached to the spine area, a layer of pressure-sensitive adhesive on the outer surface of said vinyl material opposite said backing material, said layer of adhesive being thin and of substantially lesser thickness than the thickness of said foam plastic backing material, and a strip of release paper over said adhesive, the pressure-sensitive adhesive being of a type which adheres on contact without the necessity of air-drying, the width of each said hinge forming area being great enough to accommodate turning said pad over an outer spine edge of an uncased book and also to provide a thin area for the formation of a bead in the finished book, the top and bottom edges of said outer cover being turned in to conceal the top and bottom edges of said boards and of said pad, said pad being of substantially the same length as said boards and the turned-in top and bottom edges of said outer cover adhering to the top and bottom edges of said layer of vinyl material of said pad, said layer of pressure sensitive adhesive extending substantially to the inner edges of said turned-in top and bottom edges and said release paper being longer than said layer of pressure-sensitive adhesive to provide a short tab of release paper which is not in contact with adhesive, said tab comprising a pull tab for stripping said release paper from said pad.

* * * * *